US008006854B2

(12) United States Patent
Waugh

(10) Patent No.: US 8,006,854 B2
(45) Date of Patent: Aug. 30, 2011

(54) CONTAINER

(75) Inventor: James Waugh, Miami Beach, FL (US)

(73) Assignee: The Snap Organisation USA Inc., Miami Beach, FL (US)

( * ) Notice: Subject to any disclaimer, the term of this patent is extended or adjusted under 35 U.S.C. 154(b) by 100 days.

(21) Appl. No.: 12/220,683

(22) Filed: Jul. 25, 2008

(65) Prior Publication Data

US 2010/0018943 A1 Jan. 28, 2010

(51) Int. Cl.
*B65D 51/28* (2006.01)

(52) U.S. Cl. ..... 215/386; 220/23.86; 220/23.6; 220/575; 220/23.8; 141/319

(58) Field of Classification Search ..... 220/23.86, 220/23.6, 23–86, 575, 23.8; 215/386
See application file for complete search history.

(56) References Cited

U.S. PATENT DOCUMENTS

| | | | | |
|---|---|---|---|---|
| 2,318,434 | A | 5/1943 | Strauch | |
| 2,874,835 | A | 2/1959 | Poupitch | |
| 3,027,037 | A | 3/1962 | Bronson et al. | |
| 3,724,700 | A * | 4/1973 | Heffran | 215/255 |
| 4,339,033 | A | 7/1982 | Cillario | |
| 4,634,011 | A * | 1/1987 | Polyblank | 215/6 |
| 5,005,721 | A | 4/1991 | Jordan | |
| 5,318,787 | A | 6/1994 | Brauner et al. | |
| 5,361,918 | A * | 11/1994 | Mason | 215/6 |
| 5,372,827 | A | 12/1994 | Brauner et al. | |
| 5,732,847 | A * | 3/1998 | Caldi | 220/575 |
| 5,743,423 | A * | 4/1998 | Franco | 220/23.86 |
| 6,102,233 | A | 8/2000 | Waugh | |
| 6,681,958 | B2 * | 1/2004 | Sorenson et al. | 222/145.1 |
| 7,658,294 | B2 * | 2/2010 | Housley et al. | 215/12.1 |
| 2005/0263475 | A1 * | 12/2005 | Carlson et al. | 215/11.1 |
| 2006/0169355 | A1 * | 8/2006 | Wong | 141/319 |
| 2009/0145874 | A1 * | 6/2009 | Hite | 215/227 |

FOREIGN PATENT DOCUMENTS

| | | |
|---|---|---|
| FR | 2 615 490 | 11/1988 |
| FR | 2 690 138 | 10/1993 |
| FR | 2 704 209 | 10/1994 |
| GB | 1 191 291 | 5/1970 |
| GB | 1 269 036 | 3/1972 |
| GB | 2 264 921 A | 9/1993 |
| GB | 2 289 455 A | 11/1995 |
| GB | 2 289 456 A | 11/1995 |

* cited by examiner

*Primary Examiner* — Anthony Stashick
*Assistant Examiner* — Cynthia F Collado
(74) *Attorney, Agent, or Firm* — Flynn, Thiel, Boutell & Tanis, P.C.

(57) ABSTRACT

A container for mounting on the neck of a bottle or other vessel having an annular abutment surface thereon, the container including a wall formed of two or more wall sections and an opening formed in the wall for receiving the neck of the vessel. The two wall sections are joined together by a frangible seal which allows the customer to open the container in a controlled manner, thereby reducing the risk of damage to the contents of the container.

6 Claims, 7 Drawing Sheets

CONTAINER

FIELD OF THE INVENTION

The present invention relates to a container, in particular, to a container for mounting on the neck of a bottle or other vessel having an annular abutment surface formed thereon.

BACKGROUND OF THE INVENTION

As a promotional measure, it has become increasingly common to offer gifts as an incentive to purchasers of products of various kinds, including those supplied in bottles, for example, beverages and other liquid products. Where the main purchase is supplied in a bottle, difficulty arises in finding a suitable means of mounting the container or package containing the gift on the bottle. If the gift is secured to the body of the bottle, the overall circumference of the item is increased, making it more difficult to fit an appropriate number of bottles on a shelf for display to purchasers. Whatever part of the bottle the gift is secured to, there is difficulty in securing it so that it simply cannot be removed and taken away without having been paid for.

U.S. Pat. No. 6,102,233 describes a container having a wall which defines a generally closed space; there being formed in the wall an opening for receiving the neck of a bottle. The container has a resilient retaining structure having a generally central aperture which is aligned with the opening in the container wall and is of dimensions selected to be slightly smaller than those of the annular abutment surface on the neck of the bottle to which it is to be fitted. The structure is such that, when the neck of a bottle is inserted into the container through the opening in the wall thereof, an end portion of the neck of the bottle can be forced through the aperture of the retaining structure due to its resilient nature so that a lip of the structure around the aperture engages with the abutment surface. This engagement opposes movement of the neck of the bottle back out of the container. The neck of the bottle serves to close the container so as to prevent removal of its contents of the container.

Since the neck of the bottle closes the container, the gift, or other content cannot easily be removed. Furthermore, the retaining means prevents removal of the container from the neck of the bottle so the container of U.S. Pat. No. 6,102,233 provides one means for securely fastening a gift to a bottle. However, with the container described in U.S. Pat. No. 6,102, 233, to remove the gift from the container or the container from the bottle, the container must essentially be destroyed. Although this has the advantage of making theft of the gift difficult, it has the disadvantage that, in destroying the packaging container to reach the gift, so much force is needed that the gift may be damaged in removing it from the container.

SUMMARY OF THE INVENTION

The invention provides a gift container of the kind referred to above comprising the improvement that said at least two sections joined together to form the wall defining a generally closed space are joined to one another by means of a frangible seal. The provision of a frangible seal allows the customer to open the gift container in a controlled manner, reducing the risk of damage to the contents of the container.

Preferably, the frangible seal extends around substantially the whole periphery of the wall of the container so that, when it is broken, the two sections of the wall can easily be separated from one another.

In a preferred embodiment, the frangible seal is in the form of a tear strip joined to the wall sections along opposed edges thereof by webs of reduced thickness, the tear strip being formed integrally with said sections of the wall by molding.

The tear strip may further comprise an outwardly protruding loop, the opposed edges of which are separated from adjacent sections of the wall. In use, the customer can insert a blade into the loop to cut through the loop, leaving two projecting tabs which facilitate tearing of the web between the tear strip and the sections of the wall of the container to open it.

DETAILED DESCRIPTION OF PREFERRED EMBODIMENT

Figure 1:
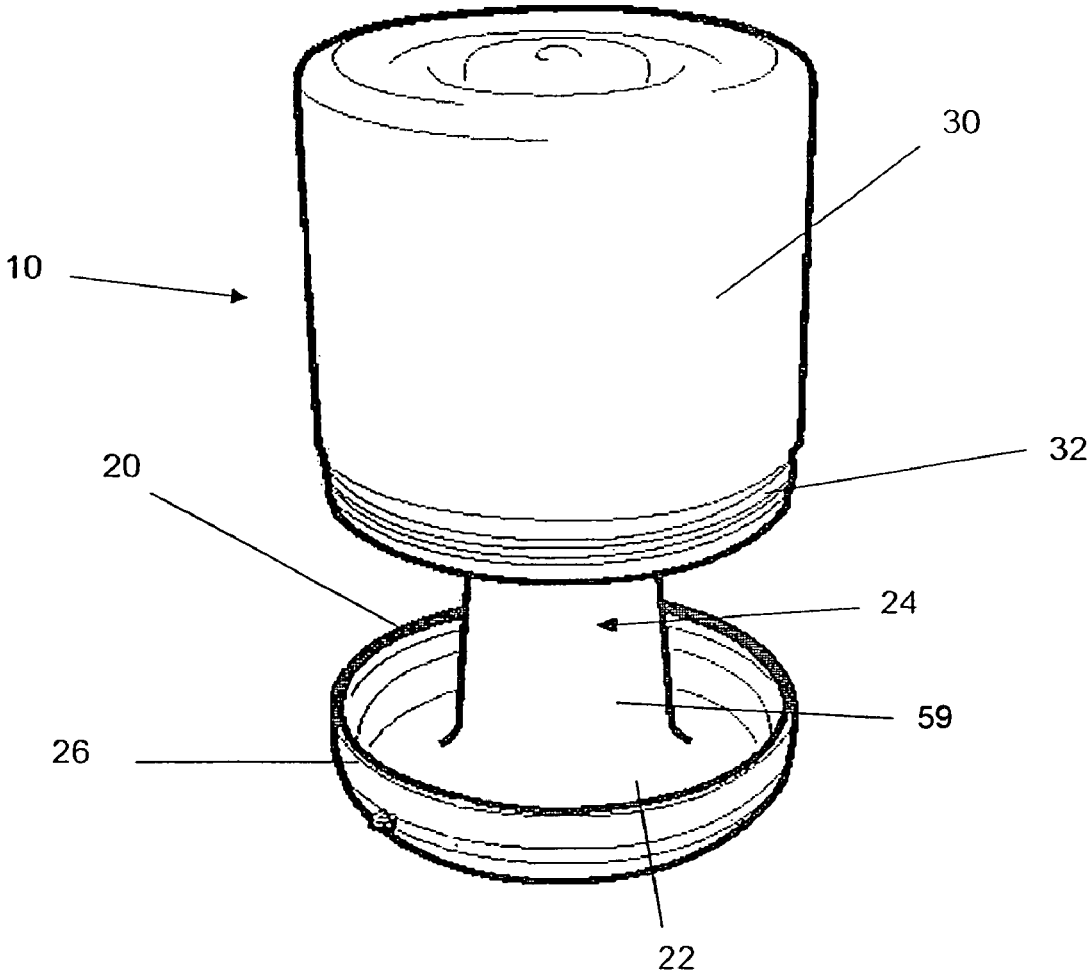
FIG. 1 is an exploded perspective view of a two-part gift container according to the invention.
Figure 2:
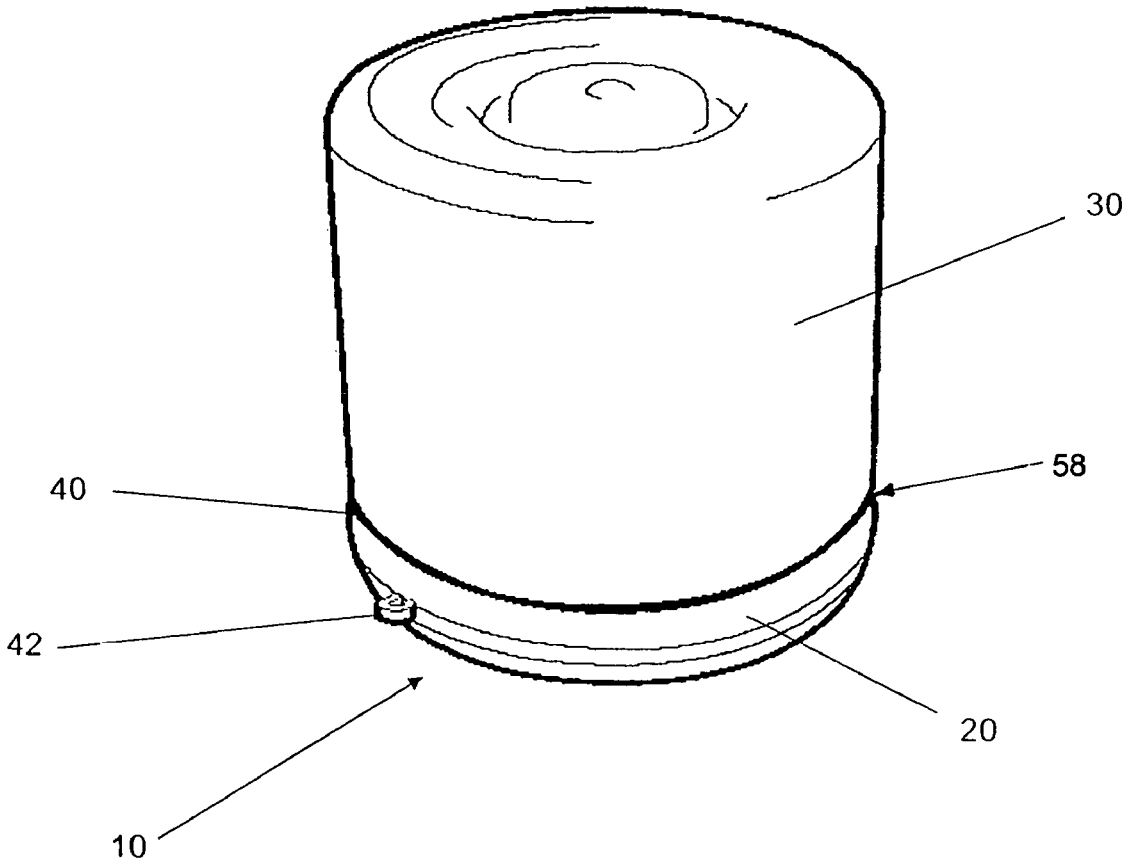
FIG. 2 is a perspective view of the container of FIG. 1.
Figure 3:
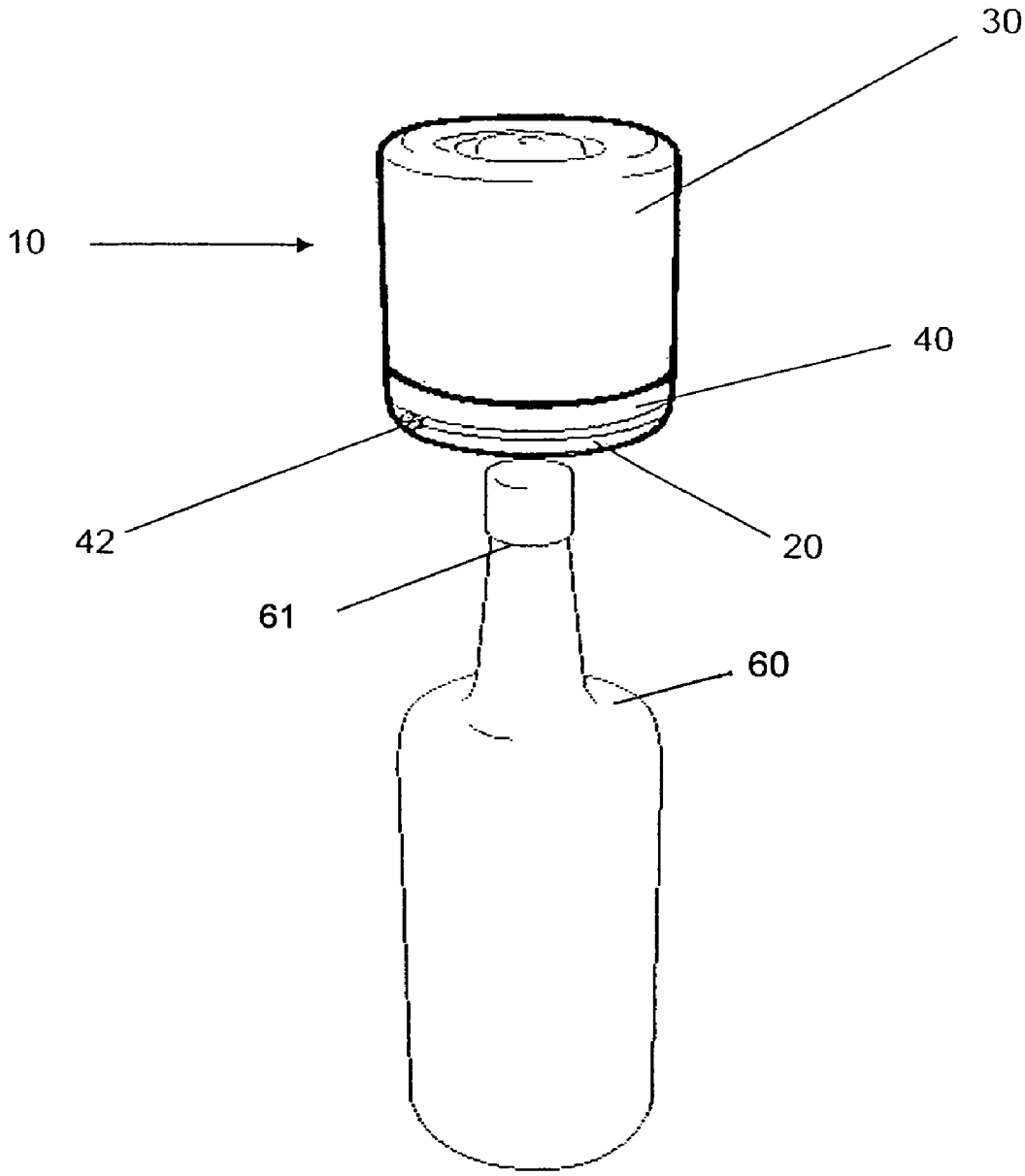
FIG. 3; shows the container of FIG. 1 as it is mounted to the neck of a bottle.
Figure 4:
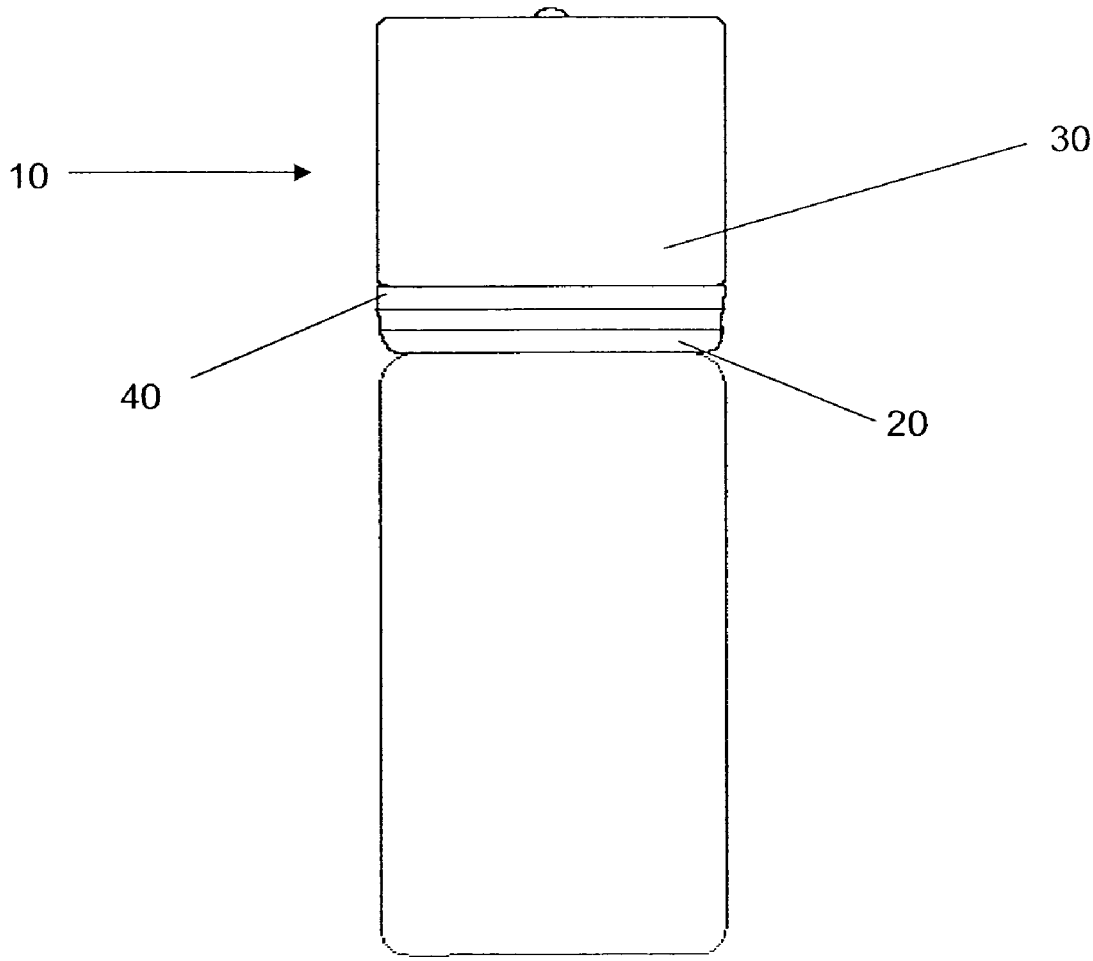
FIG. 4 shows the container in situ around the neck a bottle.
Figure 5:
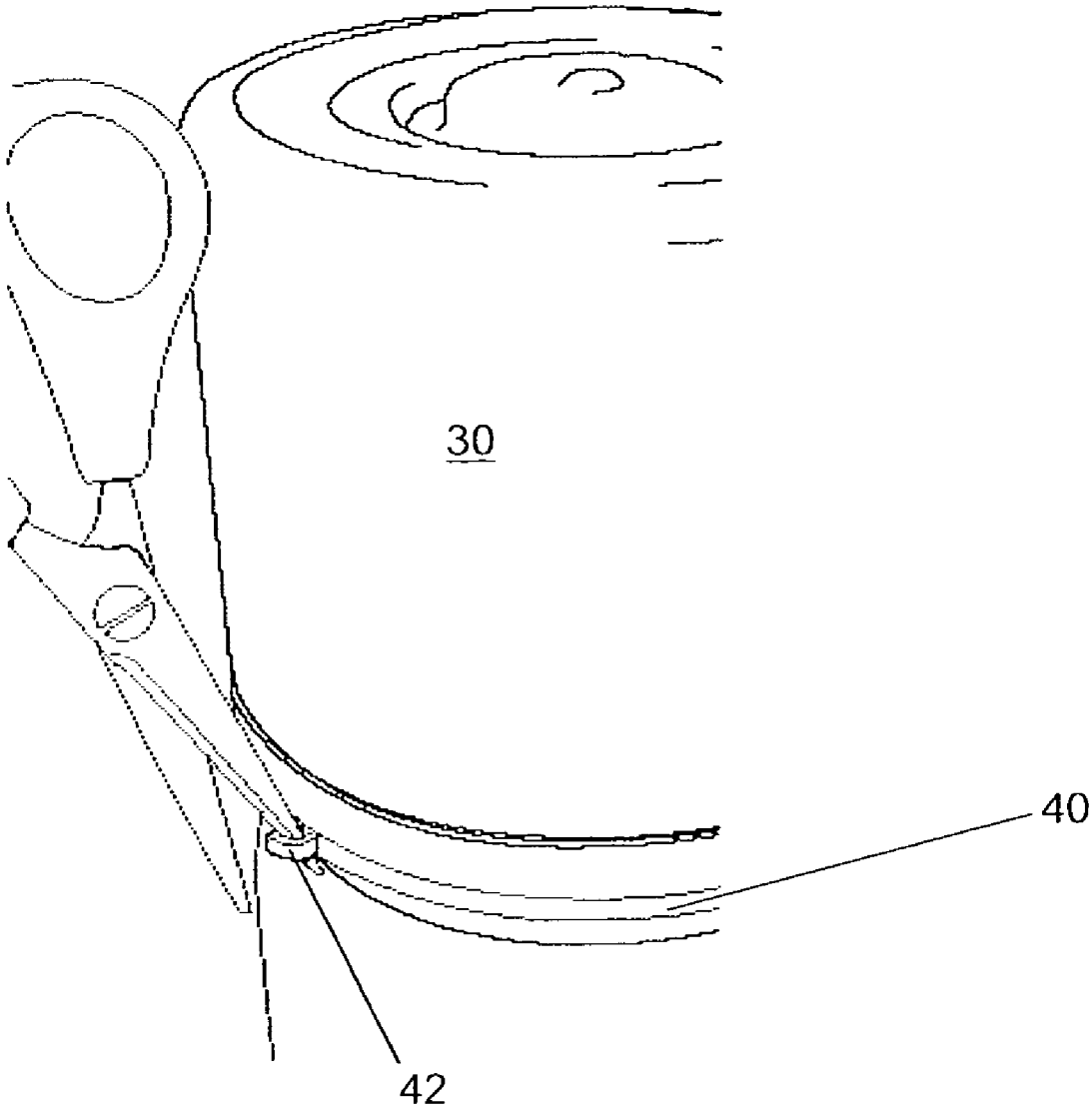
FIG. 5 a is a detailed perspective view of a part of the container of FIG. 1.
Figure 6:
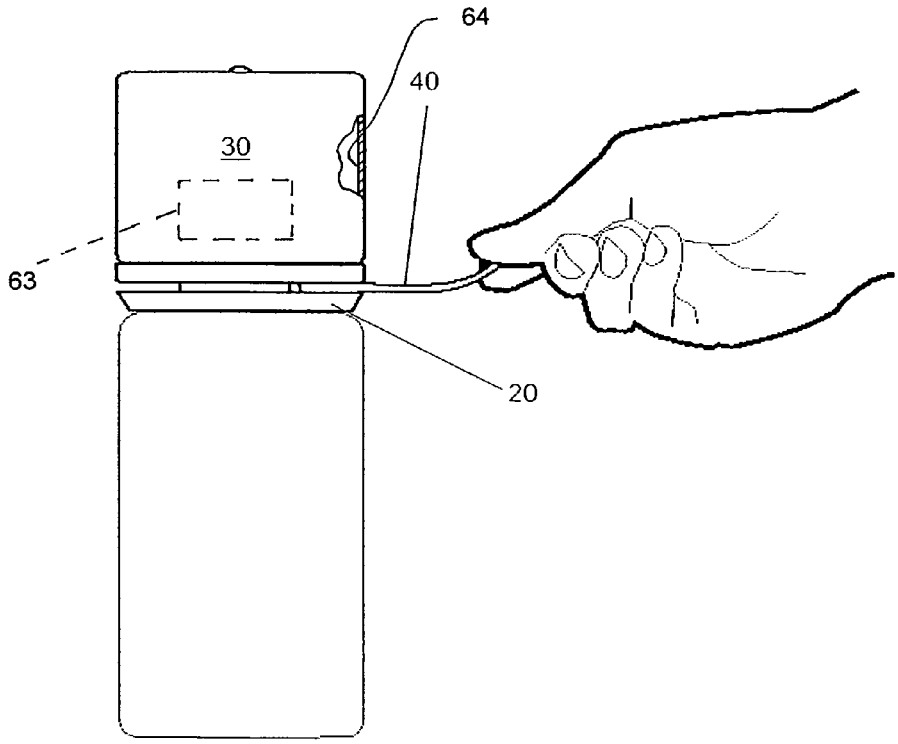
FIG. 6 shows the container of FIG. 1, part opened.

The gift container 10 of the invention is shown in FIG. 1 and comprises two main parts, an inner mounting member 20 and an outer casing 30. As discussed below, inner mounting member 20 and outer casing together form a wall or wall structure 58. Conveniently both may be made of moulded plastics material, for example, PET or PE, and may be made opaque, translucent or transparent according to choice.

Figure 7:
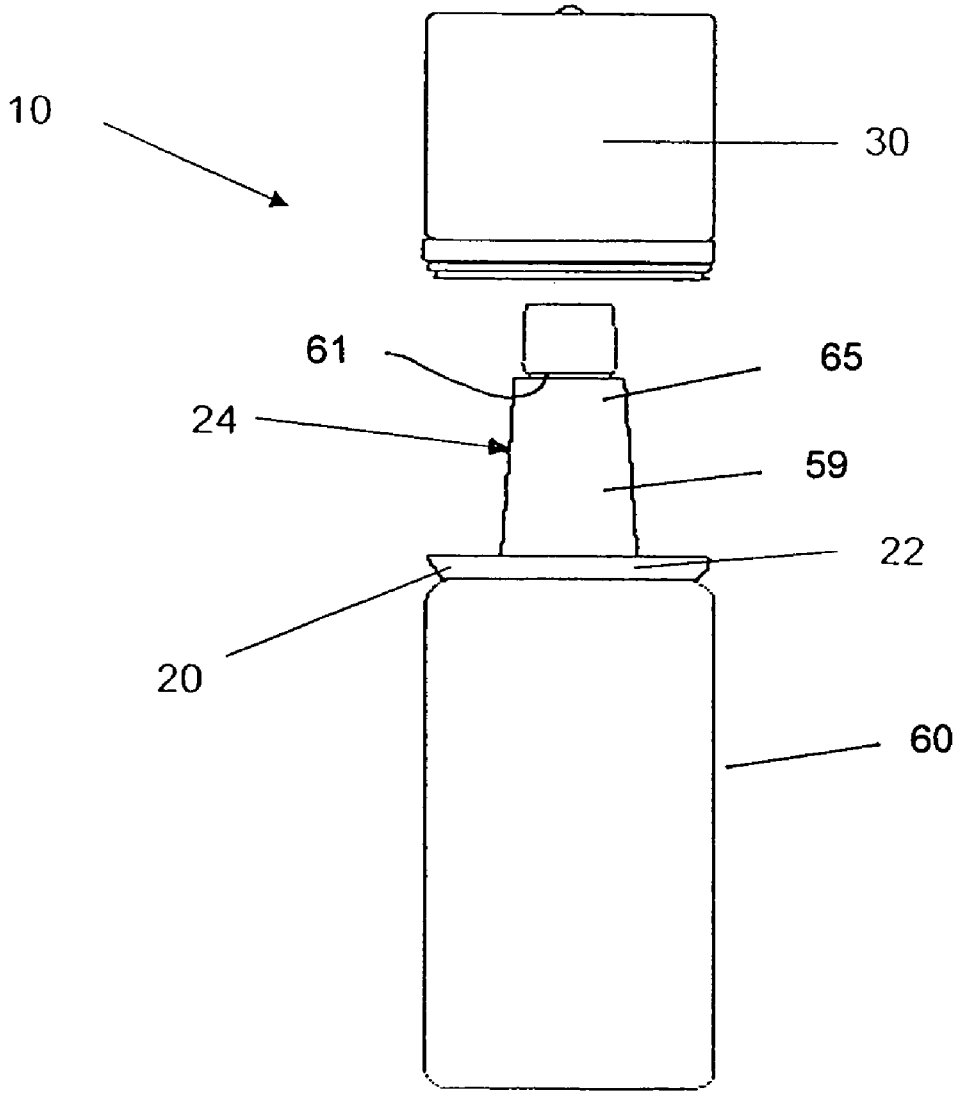
FIG. 7 shows the container of FIG. 1 fully opened and with the outer part removed.

The inner mounting member 20 has a generally annular base 22 with a retainer or resilient retaining structure 24 in the form of a conical sleeve 59 surrounding a central opening thereof. The material of the retainer 24 is chosen to be somewhat elastic or resilient and is so dimensioned that the neck of a bottle can be passed onto the central opening and through the conical sleeve 59 of the retainer 24. The open end of the conical sleeve 59 of retainer 24 expands sufficiently to allow the bottle cap to pass through it but then contracts again around the neck of the bottle 60 so that, as can be seen most clearly from FIG. 7, the edge or lip 65 of the sleeve 59 of retainer 24 lodges under the annular abutment 61 conventionally formed on the necks of bottles to allow bottle caps to be secured against, for example, pressure exerted by aerated drinks contained in them.

Thus, as is known from, for example, U.S. Pat. No. 6,102, 233, the conical shape of the sleeve 59 of retainer 24 and its engagement with the underside of the annular abutment 61 moulded onto the neck of the bottle 60 prevents the neck of the bottle 60 from being withdrawn through the sleeve 59 once the edge or lip 65 of the sleeve 59 has passed over the abutment 61 and contracted down again.

The annular base 22 of the inner mounting member 20 is formed at its edge remote from the retainer 24 with an upturned peripheral flange 26 which, as shown in the drawings may form a relatively low wall around the annular base 22. The depth or height of the upturned flange 26 is, however, a matter of choice according to considerations of aesthetics, convenience of manufacture by moulding and convenience of packing with a gift 63 which is, ultimately, to be held in the container 10. Both the annular base 22 of the mounting member 20 and its upturned flange 26 form part of the wall 58 of the gift container 10 which serves to surround the gift 63 held within the container.

The outer casing 30 may be of any suitable shape or dimensions provided that:

it is generally of a closed cup-like shape so that, when fixed to the inner mounting member 20 as will be described in detail below, it forms a largely closed internal chamber 64 which can be accessed only by means of the central opening through the sleeve 59 of the retainer 24 the peripheral edge 32 of the outer casing 30 is of similar shape and dimensions to the upturned flange 26 of the annular base 22 of the retaining member 24, so that the two can easily be joined as will be described. In practice, the shape of the outer casing 30 will be chosen so as to be aesthetically pleasing but also such that it does not extend laterally in such a way as to make stacking or transportation of bottles fitted with the gift containers 10 difficult. In some circumstances, this may mean that the overall diameter or lateral dimension of the outer casing 30 will be no greater than the diameter of the bottle to which it is to be fitted.

The two parts of the gift container 10, the inner mounting member 20 and the outer casing 30, are wall sections which are joined together around the periphery of the gift container 10 to form the generally closed container wall 58. They are, according to the invention, joined by means of a tear strip 40 or other similar frangible seal.

As shown in the drawings, in a preferred embodiment, the gift container 10 includes a tear strip 40 of the kind often used to seal food, drug and beverage containers, which extends around almost the whole of the circumference of the container. The tear strip 40 is formed of plastics material by moulding and is in the form of a relatively narrow strip which is joined to both the circumferential edge of the upturned flange 26 of the inner mounting member 20 and the adjacent edge of the outer casing 30 by a thin web which can be broken by pulling or tearing. As shown in the drawing, the tear strip 40 is moulded to form a protruding loop 42, which extends around a small arc of the circumference of the gift container 10. The protruding loop can be cut through by a purchaser with a pair of scissors, leaving a tab, or pair of tabs, which can be grasped to pull the strip 40 away from the wall 58 of the container, tearing through the frangible webs which join the tear strip 40 to the two parts of the gift container 10 and, thus, allowing them to be separated.

It will be understood that other forms of known frangible seals may be used on the exterior of the gift container 10, to permit controlled opening of the gift container 10 and to reduce the risk of damage to the contents of the container. For example, a perforated join between the two parts of the container may be provided, or the two parts may be fixed together by means of one or more loops of material threaded through the two parts of the container 10 and welded to form a permanent seal, to be cut through using scissors or some other sharp tool.

What is claimed is:

1. A container for mounting on a neck of a vessel defining an annular abutment surface thereon, said container comprising:

a substantially cup-shaped casing having a lower annular edge portion and defining an interior space which opens downwardly through said edge portion;

a retaining structure including an annular base and a sleeve member constructed of a resilient material and projecting upwardly from said base, said base being disposed outwardly from and in surrounding relation with said sleeve member, said base including an annular flange forming an outer periphery of said retaining structure and projecting upwardly towards said casing, said retaining structure defining an aperture extending through said base and said sleeve member so as to open downwardly through said base and upwardly through an upper end of said sleeve member, said aperture being sized to receive therein a neck of a vessel inserted through said base and upwardly into said aperture, said upper end of said sleeve member engaging an abutment surface of a neck of a vessel and opposing movement thereof out of said container, said retaining structure being disposed within said interior space of said casing such that said sleeve member projects upwardly into said interior space; and a frangible seal interconnecting said edge portion of said casing and said annular flange to one another to form a joint therebetween such that said retaining structure closes off said interior space of said casing, said interior space being dimensioned so as to house a gift therein, said frangible seal being connected to said casing and said flange such that breaking of said frangible seal separates said casing and said retaining structure from one another and allows access to said interior space and to a gift when located therein.

2. The container of claim 1 wherein said frangible seal extends around substantially the whole periphery of the container between said edge portion of said casing and said flange.

3. The container of claim 1 wherein said frangible seal is in the form of a tear strip joined to the edge portion of said casing and an opposed edge portion of said flange by webs of reduced thickness.

4. The container of claim 3 wherein said tear strip is formed integrally with said edge portion of said casing and the opposed edge portion of the flange by molding.

5. The container of claim 1, further comprising a gift located within said interior space, wherein breaking said frangible seal separates said casing and said retaining structure from one another and allows access to said interior space and to said gift located therein.

6. A container for mounting on a neck of a vessel defining an annular abutment surface thereon, said container comprising:

a casing defined by a first wall structure for defining a substantially closed interior space configured for housing therein a gift object, said casing defining an opening therein configured for receiving a neck of a vessel;

a resilient retaining structure disposed in the interior space, said retaining structure including a base having an aperture coaxially aligned with the opening and having dimensions smaller than that of an abutment surface of a vessel such that when a neck of a vessel is inserted into said opening, a neck of a vessel can be forced through said aperture and said retaining structure engages an abutment surface to oppose movement of a neck of a vessel out of said container, said base including an annular flange defining a second wall structure forming an outer periphery of said retaining structure and projecting upwardly towards the first wall structure of said casing;

a gift object disposed in said interior space, wherein when said container is affixed to a vessel, a vessel closes off said opening and prevents removal of said gift object from said container through said opening; and a frangible seal interconnecting an edge portion of said first wall structure of said casing to the second wall structure of said flange and defining a joint therebetween, whereby breaking said frangible seal separates said first and second wall structures from one another and allows access to the interior space and to the gift object disposed therein.

* * * * *